US007166396B2

(12) United States Patent
Qi et al.

(10) Patent No.: US 7,166,396 B2
(45) Date of Patent: Jan. 23, 2007

(54) PHOTOCONDUCTIVE IMAGING MEMBERS

(75) Inventors: Yu Qi, Oakville (CA); Nan-Xing Hu, Oakville (CA); Ah-Mee Hor, Mississauga (CA); Cheng-Kuo Hsiao, Mississauga (CA); Yvan Gagnon, Mississauga (CA); John F. Graham, Oakville (CA); Liang-Bih Lin, Webster, NY (US); Cuong Vong, Hamilton (CA)

(73) Assignee: Xerox Corporation, Stamford, CT (US)

( * ) Notice: Subject to any disclaimer, the term of this patent is extended or adjusted under 35 U.S.C. 154(b) by 322 days.

(21) Appl. No.: 10/824,218

(22) Filed: Apr. 14, 2004

(65) Prior Publication Data

US 2005/0233231 A1 Oct. 20, 2005

(51) Int. Cl.
*G03G 5/047* (2006.01)

(52) U.S. Cl. ..... 430/58.65; 430/58.8; 430/58.05

(58) Field of Classification Search ..... 430/58.65, 430/58.8, 58.05
See application file for complete search history.

(56) References Cited

U.S. PATENT DOCUMENTS

| | | | | |
|---|---|---|---|---|
| 3,121,006 | A | 2/1964 | Middleton et al. | 96/1 |
| 4,265,990 | A | 5/1981 | Stolka et al. | 430/59 |
| 4,555,463 | A | 11/1985 | Hor et al. | 430/59 |
| 4,587,189 | A | 5/1986 | Hor et al. | 430/59 |
| 4,988,597 | A | 1/1991 | Spiewak et al. | 430/62 |
| 5,008,172 | A * | 4/1991 | Rokutanzono et al. | 430/67 |
| 5,063,125 | A | 11/1991 | Yuh et al. | 430/59 |
| 5,063,128 | A | 11/1991 | Yuh et al. | 430/63 |
| 5,244,762 | A | 9/1993 | Spiewak et al. | 430/64 |
| 5,473,064 | A | 12/1995 | Mayo et al. | 540/141 |
| 5,612,157 | A | 3/1997 | Yuh et al. | 430/58 |
| 5,955,230 | A * | 9/1999 | Kimura et al. | 430/67 |
| 6,015,645 | A | 1/2000 | Murti et al. | 430/59 |
| 6,200,716 | B1 | 3/2001 | Fuller et al. | 430/64 |
| 6,218,062 | B1 | 4/2001 | Yuh et al. | 430/59.1 |
| 6,261,729 | B1 | 7/2001 | Yuh et al. | 430/65 |
| 6,287,737 | B1 | 9/2001 | Ong et al. | 430/58.8 |
| 6,300,027 | B1 | 10/2001 | Chambers et al. | 430/58.2 |
| 6,326,111 | B1 | 12/2001 | Chambers et al. | 430/58.05 |
| 6,444,386 | B1 | 9/2002 | Liu et al. | 430/64 |
| 6,492,081 | B2 * | 12/2002 | Morikawa et al. | 430/66 |

OTHER PUBLICATIONS

Jin Wu et al., US Appl. No. 10/369,816, filed Feb. 19, 2003 on Photoconductive Imaging Members.
Andronique Ioannidis et al., US Appl. No. 10/408,204, filed Apr. 4, 2003 on Imaging Members.

* cited by examiner

*Primary Examiner*—John L Goodrow
(74) *Attorney, Agent, or Firm*—E. O. Palazzo

(57) ABSTRACT

A photoconductive imaging member comprised of a substrate, a photogenerating layer, and thereover a charge transport layer comprised of a charge transport component or components, a polymer binder and metal oxide particles, wherein said metal oxide particles contain or are attached with or to a silane or a siloxane, or alternatively a polytetrafluoroethylene.

28 Claims, No Drawings

PHOTOCONDUCTIVE IMAGING MEMBERS

CROSS-REFERENCE TO RELATED APPLICATIONS

There is illustrated in U.S. Pat. No. 6,800,411, the disclosure of which is totally incorporated herein by reference, a photoconductive imaging member comprised of a substrate, a photogenerating layer, and a charge transport layer containing a binder and a compound, monomer, or oligomer containing at least two (methyl)acrylates.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in U.S. Pat. No. 6,824,940, the disclosure of which is totally incorporated herein by reference, a photoconductive imaging member containing a hole blocking layer, a photogenerating layer, a charge transport layer, and thereover an overcoat layer comprised of a polymer with a low dielectric constant and charge transport molecules.

Illustrated in U.S. Ser. No. 10/408,204, filed Apr. 4, 2003, entitled Imaging Members, U.S. Publication No. 20040197685, the disclosure of which is totally incorporated herein by reference, is a photoconductive imaging member comprised of a supporting substrate, and thereover a single layer comprised of a mixture of a photogenerator component, charge transport components, and a certain electron transport component, and a certain polymer binder.

Illustrated in copending application U.S. Ser. No. 10/144,147, entitled Imaging Members, filed May 10, 2002, now abandoned, the disclosure of which is totally incorporated herein by reference, is a photoconductive imaging member comprised of a supporting substrate, and thereover a single layer comprised of a mixture of a photogenerator component, a charge transport component, an electron transport component, and a polymer binder, and wherein the photogenerating component is a metal free phthalocyanine.

The components, such as photogenerating pigments, charge transport compounds, supporting substrates, hole blocking layers and binder polymers, and processes of the copending applications may be selected for the present invention in embodiments thereof.

BACKGROUND

This invention is generally directed to imaging members, and more specifically, the present invention in embodiments thereof is directed to multi-layered photoconductive imaging members comprised of an optional substrate, a photogenerating layer, and as a top layer a composite charge transport layer, an optional hole blocking, or undercoat layer (UCL), wherein the composite charge transport layer contains a polymer binder and metal oxide particles, such as aluminum oxide particles and optionally polytetrafluoroethylene particles (PTFE), and wherein the metal oxide particles are attached via their surfaces with a silane or a siloxane. The multi-layered photoconductive imaging members may further contain a second charge transport layer situated between the charge generating layer and the top first charge transport layer, and wherein the second charge transport layer comprises charge transport molecules and a binder polymer. The component particles in the outmost top first composite charge transport in embodiments are of a nanoparticle size of, for example, from about 1 to about 500, and more specifically, from about 1 to about 250 nanometers in diameter. These nano-size particles provide a photosensitive member with a transparent, smooth, and less friction-prone surface. In addition, the nano-size particles can provide in embodiment a photosensitive member with extended life, and reduced marring, scratching, abrasion and wearing of the surface. Further, the photoreceptor, in embodiments, has reduced or substantially no deletions. Moreover, the photoreceptor provides surface-modified alumina particles fillers with excellent dispersion characteristics in polymer binders.

Processes of imaging, especially xerographic imaging, and printing, including digital, are also encompassed by the present invention. More specifically, the photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 475 to about 950 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Illustrated in U.S. Pat. No. 6,444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

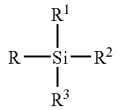

(I)

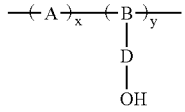

(II)

wherein R is alkyl or aryl, $R^1$, $R^2$, and $R^3$ are independently selected from the group consisting of alkoxy, aryloxy, acyloxy, halide, cyano, and amino; A and B are respectively divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water

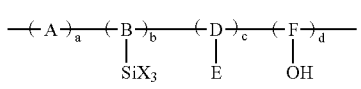

(I)

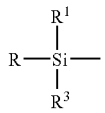

(II)

wherein, for example, A, B, D, and F represent the segments of the polymer backbone; E is an electron transporting moiety; Z is selected from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an arylamine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Japanese Patent P3286711 discloses a photoreceptor having a surface protective layer containing a conductive metal oxide micropowder with a mean grain size of 0.5 micrometer or less, and a preferred size of 0.2 micrometer or less.

U.S. Pat. No. 6,492,081 B2, the disclosure of which is totally incorporated herein by reference, discloses an electrophotographic photosensitive member with a protective layer containing metal oxide particles with a volume average particle size of less than 0.3 micrometer, or less than 0.1 micrometer.

U.S. Pat. No. 6,503,674 B2, the disclosure of which is totally incorporated herein by reference, discloses an imaging member containing a protective layer of spherical particles having a particle size of, for example, lower than 100 micrometers.

U.S. Pat. No. 5,096,795, the disclosure of which is totally incorporated herein by reference, describes an electrophotographic imaging member comprising a charge transport layer comprised of a thermoplastic film forming binder, aromatic amine charge transport molecules, and a homogeneous dispersion of at least one of organic and inorganic particles with, for example, a particle diameter of less than about 4.5 micrometers, the particles comprising, for example, a material selected from the group consisting of microcrystalline silica, ground glass, synthetic glass spheres, diamond, corundum, topaz, polytetrafluoroethylene, and waxy polyethylene.

U.S. Pat. No. 6,300,027 B1, the disclosure of which is totally incorporated herein by reference, discloses low surface energy photoreceptors containing hydrophobic silica particles uniformly dispersed in a charge transport layer. U.S. Pat. No. 6,326,111 B1, the disclosure of which is totally incorporated herein by reference, discloses a wear resistant charge transport layers containing polytetrafluoroethylene particles and hydrophobic silica.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

A number of imaging systems are based on the use of small diameter photoreceptor drums, which places a premium on photoreceptor extended life. The use of small diameter drum photoreceptors exacerbates the wear problem because, for example, 3 to 10 revolutions may be required to image a single letter size page. Multiple revolutions of a small diameter drum photoreceptor to reproduce a single letter size page can require up to 1 million cycles from the photoreceptor drum to obtain 100,000 prints.

For low volume copiers and printers, bias charging rolls (BCR) are desirable since little or no ozone is produced during image cycling. However, the microcorona generated by the BCR during charging may damage the photoreceptor, resulting in rapid wear of the imaging surface especially, for example, the exposed surface of the charge transport layer. More specifically, wear rates can be as high as about 16 microns per 100,000 imaging cycles. Similar problems are encountered with bias transfer roll (BTR) systems.

One approach to achieving longer photoreceptor drum life is to form a protective overcoat on the imaging surface, that is, the charge transporting layer. Another approach to achieving longer life is to reinforce the transport layer of the photosensitive member by adding fillers, such as low surface energy additives, and crosslinked polymeric materials. Problems can arise with these materials since they can be difficult to obtain in the nano-size particle regime (less than 100 nanometers). Fillers with larger particle sizes very often are effective scatterers of light, which can adversely affect device performance. Even with suitably sized materials, particle porosity can be a problem as the pores thereof can act as traps for gases and ions produced by the charging apparatus. When this occurs, the electrical characteristics of the photoreceptor are adversely affected. Of particular concern is the problem of deletion, a phenomenon that causes fogging or blurring of the developed image.

SUMMARY

Disclosed are imaging members with an outmost composite charge transport layer (CTL) comprised of metal oxide particles, such as alumina particles like nonporous, crystalline nad of excellent chemical purity, and with a particle size of from about 1 to about 250 nanometers; layered photoresponsive imaging members with composite outmost CTL comprised of nano-size alumina particles surface-attached with surface-active molecules, such as a silane or a siloxane, to, for example, achieve a uniform dispersion in the polymer binder and a uniform coating for the composite CTL, and which members possess decreased susceptibility to marring, scratching, micro-cracking and abrasion; and where image deletions are minimized; a composite CTL comprised of polytetrafluoroethylene aggregates having an average size of less than about 1.5 microns dispersed into the composite CTL; layered photoresponsive imaging members, which exhibit excellent electrical performance characteristics; members with excellent wear resistance and durability, and layered photoresponsive imaging members that are transparent, smooth, and possess wear resistance.

DETAILED DESCRIPTION OF PREFERRED EMBODIMENTS

Aspects of the present disclosures relate to a photoconductive imaging member comprised of a substrate, a photogenerating layer, and thereover a charge transport layer comprised of a charge transport component or components, a polymer binder and metal oxide particles, wherein the metal oxide particles are attached with a silane or a siloxane; a photoconductive imaging member comprised of a substrate, a photogenerating layer, and in contact with the photogenerating layer a composite charge transport layer comprised of an aromatic resin and metal oxide particles, wherein the metal oxide particles are surface-attached with an arylsilane/arylsiloxane component having π—π interactions with the aromatic resin; a photoconductive imaging member comprised of a conductive metal substrate selected from the group consisting of an aluminum drum, an aluminized polyethylene terephthalate or a titanized polyethylene terephthalate; a photogenerating layer comprised of a pigment selected from the group consisting of hydroxygallium phthalocyanine and chlorogallium phthalocyanine; an outmost or first composite charge transport layer comprised of a hole transport selected from the group consisting of N,N'-diphenyl-N,N-bis(3-methyl phenyl)-1,1'-biphenyl-4,4'-diamine and N,N-bis(3,4-dimethyl phenyl)-N-biphenylamine, a polycarbonate binder, and crystalline aluminum oxide particles attached with a silane; a photoconductive imaging member wherein the supporting substrate is comprised of a conductive metal substrate; a photoconductive imaging member wherein the conductive substrate is aluminum, aluminized polyethylene terephthalate or a titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in an optional resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy, and/or acid containing monomers, polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the charge transport aryl amines are, for example, of the formula

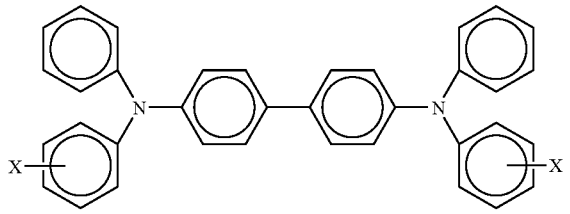

wherein X is selected from the group consisting of alkyl, alkoxy, and halogen, and wherein the aryl amine is dispersed in a resinous binder; a photoconductive imaging member wherein the aryl amine alkyl is methyl wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or mixtures thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; an imaging member wherein the hole blocking layer phenolic compound is bisphenol S, 4,4'-sulfonyldiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl)methane; an imaging member wherein the phenolic compound is bisphenol M, 4,4'-(1,3-phenylenediisopropylidene) bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member comprised in the sequence of a supporting substrate, a hole blocking layer, an optional adhesive layer, a photogenerating layer, a hole transport layer and the overcoating layer as illustrated herein; an imaging member wherein the adhesive layer is comprised of a polyester with an $M_w$ of from about 40,000 to about 75,000, and an $M_n$ of from about 30,000 to about 45,000; an imaging member wherein the photogenerator layer is of a thickness of from about 1 to about 5 microns, and wherein the transport layer is of a thickness of from about 20 to about 65 microns; an imaging member wherein the photogenerating layer is comprised of photogenerating pigments dispersed in a resinous binder in an amount of from about 10 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises suitable known or future developed components; an imaging member wherein the photogenerating layer is comprised of metal phthalocyanines, or metal free phthalocyanines; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; a method of imaging which comprises generating an electrostatic latent image on the imaging member illustrated herein, developing the latent image with a known toner, and transferring the developed electrostatic image to a suitable substrate like paper; a charge generation layer is prepared by dispersing a photogenerating pigment coating liquid containing hydroxy gallium phthalocyanine pigment of from about 10 to about 30 parts, a VMCH resin of from about 10 to about 30 parts, and n-butylacetate from about 900 to about 990 parts, followed by milling in a glass jar with stainless steel balls for an extended period of time of from about 6 to about 36 hours; a charge transport layer prepared by mixing the charge transport layer component coating liquid containing bisphenol Z-form polycarbonate of from about 90 to about 120 parts, an aryl amine of from about 50 to about 90 parts, monochlorobenzene from 0 to about 470 parts, tetrahydrofuran from 0 to about 470 parts, and BHT from about 1 to about 10 parts in a glass jar, and roll milling for an extended period of time of about 6 to about 36 hours; a composite charge transport layer containing NANOTEK® alumina particles in an amount of from about 2 to about 40 parts prepared by dispersing in a sonicator bath with solvent and then mixing with above charge transport liquid and roll milling for an extended period of time of about 6 to about 36 hours; and wherein polytetrafluoroethylene (PTFE) predispersed with a surfactant (GF300) in solvent by sonication added to the above formulation at range between about 1 to about 10 parts to form a stable dispersion.

The charge generation layer, charge transport layer and the composite charge transport layer were coated by solution coating with a draw bar. Other methods, such as wire wound rod, dip coating and spray coating, can also be used. Charge generation layer between about 0.1 μm to about 2 μm was coated onto an aluminized or titanized MYLAR® with silane undercoating layer or onto aluminum drum with silane coated undercoating layer. The composite charge transport layer comprising alumina particles was coated on the top of charge generation layer to form a layer with a thickness of from about 10 μm to about 35 μm. Alternatively, a layer of composite charge transport liquid containing alumina particles was coated onto a standard, or filler-free charge transport layer of about 10 μm to about 30 μm thick to form a protective overcoat layer of about 1 μm to about 15 μm thick. In embodiments, each layer was individually dried prior to the disposition of the other layers.

Examples of the metal oxide particles include aluminum oxide, silicon oxide, titanium oxide, cerium oxide, and zirconium oxide commercially available alumina NANOTEK®, available from Nanophase alumina. NANOTEK® alumina particles are of a spherical shape with nonporous, highly crystalline with, for example, about 50 percent of a γ-type crystalline structure; high surface area and chemical purity. Upon dispersion in a polymer binder, NANOTEK® alumina particles possess high surface area to unit volume ratio, and thus have a larger interaction zone with dispersing medium.

In embodiments, the alumina particles are spherical or crystalline-shaped. The crystalline form contains, for example, at least about 50 percent of γ-type. The particles can be prepared via plasma synthesis or vapor phase synthesis in embodiments. This synthesis distinguishes these particles from those prepared by other methods (particularly hydrolytic methods) in that the particles prepared by vapor phase synthesis are nonporous as evidenced by their relatively low BET values. An example of an advantage of such prepared particles is that the spherical-shaped or crystalline-shaped nano-size particles are less likely to absorb and trap gaseous corona effluents. More specifically, the plasma reaction includes a high vacuum flow reactor, and a metal rod or wire, which is irradiated to produce intense heating creating plasma-like conditions. Metal atoms, such as aluminum, are boiled off and transported downstream where they are quenched and quickly cooled by a reactant gas like oxygen to produce spherical low porosity nano-sized metal oxides. Particle properties and size are controlled by the temperature profiles in the reactor as well as the concentration of the quench gas.

In embodiments, the nano-size alumina particles are of a BET value of from about 1 to about 75, from about 20 to about 40, or about 42 $m^2/g$. BET, which refers to Brunauer, Emmett and Teller, is used to measure the surface area of fine particles. The BET theory and the measurement method can be located in Webb Orr, *Analytical Methods in Fine Particles Technology,* 1997. Specific examples of alumina particles include particles with an average particle diameter size of from about 1 to about 250 nanometers, from about 1 to about 199 nanometers, from about 1 to about 195 nanometers, from about 1 to about 175 nanometers, from about 1 to about 150 nanometers, from about 1 to about 100 nanometers, or from about 1 to about 50 nanometers.

In embodiments, the metal oxide particles are surface treated to ensure a suitable dispersion in the charge transport layer and the formation of uniform coating film. The aluminum oxide particles can be treated with a surface-active agent to passivate the particle surface. Examples of surface-active agents include organohalosilanes, organosilanes, organosilane ethers, the titanium analogs thereof, and the like, and more specifically, agents of the formula of (I)

$$R—Z(X)_nY_{3-n} \quad (I)$$

wherein R and X each independently represents an alkyl group, an aryl group, a substituted alkyl group or a substituted aryl group; Z represents a silicon atom, titanium atom and the like; Y represents a hydrogen atom, a halogen atom, a hydroxyl group, an alkoxy group, and an allyl group; n represents the number of repeating segments $$R—Si(X)_nY_{3-n} \quad (II)$$

wherein R and X each independently represents an alkyl group, an aryl group, a substituted alkyl group, a substituted aryl group, an organic group containing carbon-carbon double bonds, carbon-carbon triple bonds, and an epoxy-group; Y represents a hydrogen atom, a halogen atom, a hydroxyl group, an alkoxy group, and an allyl group; and n is as illustrated herein.

In embodiment, examples of R and X include alkyl groups containing from about 1 carbon atom to about 30 carbon atoms, such as methyl, ethyl, propyl, isopropyl, butyl, sec-butyl, tert-butyl, pentyl, hexyl, heptyl, octyl, dodecyl, cyclohexyl and the like, halogen like chlorine substituted alkyl groups containing from about 1 to about 30 carbon atoms, such as chloromethylene, trifluoropropyl, tridecafluoro-1,1,2,2-tetrahydrooctyl and the like. R can comprise aryl groups containing from about 6 to about 60 carbon atoms, such as phenyl, alkylphenyl, biphenyl, benzyl, phenylethyl, and the likes; halogen substituted aryl groups containing from about 6 to about 60 or from about 6 to about 18 carbon atoms, such as chlorophenyl, fluorophenyl, perfluorophenyl and the like; an organic group containing carbon-carbon double bonds of from about 1 to about 30 carbon atoms, such as γ-acryloxypropyl, a γ-methacryloxypropyl and a vinyl group; an organic group containing carbon-carbon triple bond of from about 1 to about 30 carbon atoms, such as acetylenyl, and the like; an organic group containing an epoxy group, such γ-glycidoxypropyl group and β-(3,4-epoxycyclohexyl)ethyl group, and the like; Y is a hydrogen atom, a halogen atom such as chlorine, bromine, and fluorine; a hydroxyl group; an alkoxy group such as methoxy, ethoxy, iso-propoxy and the like; and an allyl group.

Specific examples of surface-active agents include methyltrimethoxysilane, ethyltrimethoxysilane, methyltriethoxysilane, propyltrimethoxysilane, octyltrimethoxysilane, trifluoropropyltrimethoxysilane, tridecafluoro-1,1,2,2-tetrahydrooctyltrimethoxysilane, p-tolyltrimethoxysilane, phenyltrimethoxysilane, phenylethyltrimethoxysilane, benzyltrimethoxysilane, diphenyldimethoxysilane, dimethyldimethoxysilane, diphenyldisilanol, cyclohexylmethyldimethoxysilane, vinyltrimethoxysilane, 3-glycidoxypropyl trimethoxy-silane, 3-(trimethoxysilyl) propylmethacrylate, or mixtures thereof.

The metal oxide particles can also be attached to each other with a cyclic siloxane of formula (III)

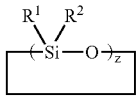

(III)

wherein $R^1$ and $R^2$ each independently represents an alkyl group of from about 1 to about 30 carbon atoms; an aryl group, for example, containing from about 6 to about 60 carbon atoms; a substituted alkyl group or a substituted aryl group, for example, containing from about 1 to about 30 carbon atoms, and z represents the number of repeating segments and can be an integer of from about 3 to about 10. Examples of cyclic siloxane from a group are hexamethylcyclotrisiloxane, 2,4,6-trimethyl-2,4,6-triphenylcyclotrisiloxane, 2,4,6,8-tetramethyl-2,4,6,8-tetraphenylcyclotetrasiloxane, hexaphenylcyclotrisiloxane, octamethylcyclotetrasiloxane, octaphenylcyclo tetrasiloxane, or 2,4,6,8-tetramethyl-2,4,6,8-tetravinylcyclotetrasiloxane.

In embodiments, the metal oxide particles can be surface-attached with silane or siloxane molecules forming a π—π interaction with the binder polymer; π—π interactions are considered a type of attractive noncovalent bonding. In biological systems, the π—π interactions, especially aromatic-aromatic interactions, can be of importance in stabilizing the native structure of proteins and the helix-helix structure of DNA ((a) Burley, S. K.; Petsko, G. A. *Science,* 1985, 229, 23. (b) Hunter, C. A. and Sanders, J. K. M. *J. Am. Chem. Soc.,* 1990, 112, 5525). Through π—π interactions between phenyl groups of an organic polymer and those at surface of silica gel, a homogeneous polystyrene and silica gel polymer hybrids have been prepared utilizing the sol-gel reaction of phenyltrimethoxysilane (Tamaki, R., Samara, K. and Chujo, Y., *Chem, Commun.,* 1998, 1131). In embodiments of the present invention, the outmost composite charge transport layer is comprised of an aromatic resin and metal oxide particles wherein the metal oxide particles are surface-attached with an arylsilane/arylsiloxane component having π—π interactions with the aromatic resin. The typical aryl group in the silane or siloxane molecule is selected from the group consisting of a phenyl, a naphthyl, a benzyl, a phenylalkyl, and the like. The typical example of aromatic resin is selected from a group consisting of an aromatic polycarbonate, an aromatic polyester, an aromatic polyether, an aromatic polyimide, an aromatic polysulfone and the like. The surface-attached alumina particles, for example with phenyltrimethoxysilane, phenylethyltrimethoxysilane, form uniform dispersion in CTL solutions comprising a hole transport molecule and an aromatic polycarbonate binder. The composite CTL prepared as such forms uniform coating film and results in excellent electrical performance of photoreceptor devices.

In embodiments, the metal oxide particles are surface treated by dispersing alumina particles with a surface-active agent or agents in an inert solvent by high power sonication for a suitable length of time, and heating the dispersion to allow reaction and passivation of the metal oxide surface. Removal of solvent then affords the surface-treated particle. The amount of surface treatment obtained can be ascertained by thermal gravimetric analysis. Generally, a 1 to 10 percent weight increase is observed indicating successful surface treatment.

The outmost composite charge transport layer can further contain polytetrafluoroethylene (PTFE) particles, reference U.S. Pat. No. 6,326,111 and U.S. Pat. No. 6,337,166, the disclosure of each being totally incorporated herein by reference. PTFE particles are available commercially, including, for example, MP1100 and MP1500 from DuPont Chemical and L2 and L4, Luboron from Daikin Industry Ltd., Japan. The diameter of the PTFE particles is preferably less than about 0.5 micron, or less than about 0.3 micron; the surface of these PTFE particles is preferably smooth to prevent air bubble generation during the dispersion preparation process. Air bubbles in the dispersion can cause coating defects on the surface which initiate toner cleaning failure. The PTFE particles can be included in the composition in an amount of from, for example, about 0.1 to about 30 percent by weight, more specifically about 1 to about 25 percent by weight, and yet more specifically about 3 to 20 percent by weight of the charge transport layer material. PTFE particles can be incorporated into a dispersion together with a surfactant, and which PTFE particles aggregate into uniform aggregates during high shear mixing, and remain stable and uniformly dispersed throughout the dispersion. Preferably, the surfactant is a fluorine-containing polymeric surfactant, such as a fluorine graft copolymer, for example GF-300 available from Daikin Industries. These types of fluorine-containing polymeric surfactants are described in U.S. Pat. No. 5,637,142, the disclosure of which is totally incorporated herein by reference. The GF-300 (or other surfactant) level in the composition permits, for example, excellent dispersion qualities and high electrical properties. The amount of GF-300 in the dispersion can depend on the amount of PTFE; as the PTFE amount is increased, the GF-300 amount should be proportionally increased to maintain the PTFE dispersion quality, for example the surfactant (GF-300) to PTFE weight ratio is from about 1 to about 4 percent, from about 1.5 to about 3 percent, or from about 0.02 to about 3 percent by weight of surfactant.

The following Examples are provided.

EXAMPLE I

Surface Treatment of NANOTEK® Alumina with Phenyltrimethoxysilane

NANOTEK® alumina particles (10 grams) were dispersed in chlorobenzene (100 grams) containing phenyltrimethoxysilane (1 gram) with a probe sonicator (525 w) for 10 minutes. The resulting dispersion was then heated at 100° C. for 12 hours. After cooling to room temperature (25° C.), the chlorobenzene solvent was evaporated and the remaining solids were dried at 160° C. for 12 hours. After cooling to room temperature (25° C.), the dried particles can be used to prepare the CTL (charge transport layer).

EXAMPLE II

Surface Treatment of NANOTEK® Alumina with Methyltrimethoxysilane

NANOTEK® alumina particles (1 gram) were dispersed in chlorobenzene (10 grams) containing methyltrimethoxysilane (0.1 gram) with a probe sonicator (525 w) for 10 minutes. The resulting dispersion was then heated at 100° C. for 12 hours. After cooling to room temperature (25° C.), the solvent was evaporated and the remaining solids were dried at 160° C. for 12 hours. After cooling to room temperature (25° C.), the dried particles can be used to prepare the CTL.

EXAMPLE III

Surface Treatment of NANOTEK® Alumina with Octyltrimethoxysilane

NANOTEK® alumina particles (1 gram) were dispersed in chlorobenzene (10 grams) containing octyltrimethoxysilane (0.1 gram) with a probe sonicator (525 w) for 10 minutes. The resulting dispersion was then heated at 100° C. for 12 hours. After cooling to room temperature (25° C.), the solvent was evaporated and remaining solids were dried at 160° C. for 12 hours. After cooling to room temperature (25° C.), the dried particles can be used to prepare the CTL.

EXAMPLE IV

Electrical and Wear Testing

The xerographic electrical properties of prepared photoconductive imaging members in the Examples that follow can be determined by known means, including electrostatically charging the surfaces thereof with a corona discharge source, until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter. The photosensitivity of the imaging member was usually provided in terms of the amount of exposure energy in ergs/cm$^2$, designated as $E_{1/2}$, required to achieve 50 percent photodischarge from $V_{ddp}$ to half of its initial value. The higher the photosensitivity, the smaller was the $E_{1/2}$ value. The $E_{7/8}$ value corresponded to the exposure energy required to achieve 7/8 photodischarge from $V_{ddp}$. The device was finally exposed to an erase lamp of appropriate light intensity and any residual potential ($V_{residual}$) was measured. The imaging members were tested with a monochromatic light exposure at a wavelength of 780 +/−10 nanometers and an erase light with the wavelength of 600 to 800 nanometers and intensity of 200 ergs.cm$^2$.

The photoreceptor devices were then mounted on a wear test fixture to determine the mechanical wear characteristics of each device. Photoreceptor wear was determined by the change in thickness of the photoreceptor before and after the wear test. The thickness was measured using a permascope at one-inch intervals from the top edge of the coating along its length using a permascope ECT-100. All of the recorded thickness values were averaged to obtain the average thickness of the entire photoreceptor device. For the wear test the photoreceptor was wrapped around a drum and rotated at a speed of 140 rpm. A polymeric cleaning blade was brought into contact with the photoreceptor at an angle of 20 degrees and a force of approximately 60 to 80 grams/cm. A known single component toner (resin and colorant) was trickled on the photoreceptor at a rate of 200 mg/minute. The drum was rotated for 150 kcycles during a single test. The wear rate was equal to the change in thickness before and after the wear test divided by the number of kcycles.

EXAMPLE V

Composite Charge Transport Layer with 5 Weight Percent Grafted-Alumina (Belt Device)

On a 75 micron thick titanized MYLAR® substrate there was coated by the known draw bar technique a barrier layer formed from a hydrolyzed gamma aminopropyltriethoxysilane having a thickness of 0.005 micron. The barrier layer coating composition was prepared by mixing 3-aminopropyltriethoxysilane with ethanol in a 1:50 volume ratio; the coating was allowed to dry for 5 minutes at room temperature (22° C. to 25° C.), followed by curing for 10 minutes at 110° C. in a forced air oven. On top of the barrier layer there was coated a 0.05 micron thick adhesive layer prepared from a solution of 2 weight percent of DuPont 49K (49,000) polyester in dichloromethane. A 0.2 micron photogenerating layer was then coated on top of the adhesive layer with a wire wound rod from a dispersion of hydroxy gallium phthalocyanine Type V (22 parts) and a vinyl chloride/vinyl acetate copolymer binder, VMCH ($M_n$=27,000, about 86 weight percent of vinyl chloride, about 13 weight percent of vinyl acetate and about 1 weight percent of maleic acid) available from Dow Chemical (18 parts), in 960 parts of n-butylacetate, followed by drying at 100° C. for 10 minutes. Subsequently, a 24 μm thick charge transport layer (CTL) was coated on top of the photogenerating layer by a draw bar from a dispersion of phenyltrimethoxysilane surface grafted alumina particles (9 parts), N,N'-diphenyl-N,N-bis(3-methylphenyl)-1,1'-biphenyl-4,4'-diamine (67.8 parts), 1.7 parts of 2,6-di-tert-butyl-4-methylphenol (BHT) obtained from Aldrich Chemical and a polycarbonate, PCZ-400 [poly(4,4'-dihydroxy-diphenyl-1-1-cyclohexane), $M_w$=40,000] available from Mitsubishi Gas Chemical Company, Ltd. (102 parts) in a mixture of 410 parts of tetrahydrofuran (THF) and 410 parts of monochlorobenzene. The CTL was dried at 115° C. for 60 minutes.

The above dispersion with the solid components of the surface treated alumina particles of Example I was prepared by predispersing the alumina in a sonicator bath (Branson Ultrasonic Corporation Model 2510R-MTH) with monochlorobenzene followed by adding the mixture to the charge transport liquid to form a stable dispersion, followed by roll milling for about 6 to about 36 hours before coating. The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 811 | 1.94 | 14 | 11.2 | 41.5 |
| Device with $Al_2O_3$ | 816 | 1.77 | 20 | 3.7 | 15.2 |

EXAMPLE VI

Composite Charge Transport Layer with 5 Weight Percent Grafted-Alumina (Belt Device)

An electrophotoconductor was prepared in the same manner as described in the Example V except that the following charge transport coating liquid containing 5 weight percent of alumina particles pretreated with methyltrimethoxysilane from Example II was used.

| | |
|---|---|
| Bisphenol Z-form polycarbonate | 102.7 parts |
| TBD | 68.4 parts |
| Monochlorobenzene | 820 parts |
| Alumina particles | 9 parts |

The charge transport coating dispersion was coated with a draw bar resulting in a CTL thickness of 25 μm after drying. The electrical and wear properties of the resulting photoconductive member was measured in accordance with the procedure described in Example IV.

| Device | $V_{ddp}$ (−V) | $E_{1/2}$ (Ergs/cm)$^2$ | Dark Decay (V @ 500 ms) | Vr (V) | Wear (nm/k cycles) |
|---|---|---|---|---|---|
| Control Device Without $Al_2O_3$ | 811 | 1.94 | 14 | 11.2 | 41.5 |
| Device with 5 weight percent of $Al_2O_3$ | 823 | 1.56 | 34 | 3 | N/A |

EXAMPLE VII

Composite Charge Transport Layer with 5 Weight Percent Grafted-Alumina (Belt Device)

An electrophotoconductor was prepared in the same manner as described in the Example V except that the following charge transport coating liquid containing 5 weight percent of alumina particles pretreated with octyltrimethoxysilane from Example III was used.

| | |
|---|---|
| Bisphenol Z-form polycarbonate | 102.6 parts |
| TBD (Hole Transport) | 68.4 parts |
| Monochlorobenzene | 820 parts |
| Alumina particles | 9 parts |

The charge transport coating dispersion was coated with a draw bar to arrive at a thickness of 25 μm after drying. The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 811 | 1.94 | 14 | 11.2 | 41.5 |
| Device with 5 weight percent $Al_2O_3$ | 817 | 1.30 | 22 | 15 | N/A |

EXAMPLE VIII

Composite Charge Transport Layer with 5 Weight Percent Grafted-Alumina (Belt Device)

An electrophotoconductor was prepared in the same manner as described in Example V except that the following charge transport coating liquid containing 5 weight percent untreated alumina particles was used.

| | |
|---|---|
| Bisphenol Z-form polycarbonate | 98.1 parts |
| TBD | 65.4 parts |
| Monochlorobenzene | 828 parts |
| Alumina particles | 8.6 parts |

The charge transport coating dispersion was coated with a draw bar resulting in a thickness of 25 μm after drying. The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 811 | 1.94 | 14 | 11.2 | 41.5 |
| Device with 5 weight percent untreated $Al_2O_3$ | 864 | 2.07 | 24 | 239 | 10.1 |

EXAMPLE IX

Composite Charge Transport Layer with 3 Weight Percent Treated-Alumina (Belt Device)

An electrophotoconductor was prepared in the same manner as described in the Example V except that the following charge transport coating liquid containing 3 weight percent of alumina particles pretreated with phenyltrimethoxysilane from Example I was used.

| | |
|---|---|
| Bisphenol Z-form polycarbonate | 104 parts |
| TBD | 69 parts |
| Monochlorobenzene | 410 parts |
| Tetrahydrofuran | 410 parts |
| BHT | 1.75 parts |
| Alumina particles | 5.4 parts |

The charge transport coating dispersion was coated with a draw bar to a thickness of 25 μm after drying. The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 811 | 1.94 | 14 | 11.2 | 41.5 |
| Device with 3 weight percent $Al_2O_3$ | 813 | 1.79 | 18 | 6.1 | 16.1 |

EXAMPLE X

Composite Charge Transport Layer with 1.5 Weight Percent Treated-Alumina (Belt Device)

An electrophotoconductor was prepared in the same manner as described in the Example V except that the following charge transport coating liquid containing 1.5 weight percent of the alumina particles of Example I were used.

| | |
|---|---|
| Bisphenol Z-form polycarbonate | 105.3 parts |
| TBD | 70.2 parts |
| Monochlorobenzene | 410 parts |
| Tetrahydrofuran | 410 parts |
| BHT | 1.8 parts |
| Alumina particles | 2.7 parts |

The charge transport coating dispersion was coated with draw down blade to a thickness of 25 μm after drying. The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 810 | 1.79 | 13 | 9.0 | 41.5 |
| Device with 1.5 weight percent $Al_2O_3$ | 813 | 1.74 | 18 | 5.1 | 22.9 |

EXAMPLE XI

Composite Charge Transport Layer with 5.5 Weight Percent Treated-Alumina (Drum Device)

A titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ about 3,600, viscosity about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin was prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$VARCUM™ dispersion. Additional solvents of 5 grams of 1-butanol, and 5 grams of xylene; 2.6 grams of bisphenol S (4,4'-sulfonyldiphenol), and 5.4 grams of the above prepared $SiO_2$/VARCUM™ slurry were added to 50 grams of the above resulting titanium dioxide/VARCUM™ dispersion referred to as the coating dispersion. Then, an aluminum drum, cleaned with detergent and rinsed with deionized water, was dip coated with the coating dispersion at a pull rate of 160 millimeters/minute, and subsequently dried at 160° C. for 15 minutes, which resulted in an undercoat layer (UCL) comprised of $TiO_2$/$SiO_2$/VARCUM™/bisphenol S with a weight ratio of about 52.7/3.6/34.5/9.2 and a thickness of 3.5 microns.

A 0.5 micron thick photogenerating layer was subsequently dip coated on top of the above generated undercoat layer from a dispersion of Type V hydroxygallium phthalocyanine (12 parts), alkylhydroxy gallium phthalocyanine (3 parts), and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 24 μm thick charge transport layer (CTL) was dip coated on top of the photogenerating layer from a dispersion of alumina particles surface treated with phenyltrimethoxysilane (12.1 parts), N,N'-diphenyl-N,N-bis(3-methylphenyl)-1,1'-biphenyl-4,4'-diamine (82.3 parts), 2.1 parts of 2,6-di-tert-butyl-4-methylphenol (BHT) obtained from Aldrich Chemical and a polycarbonate, PCZ-400 [poly (4,4'-dihydroxy-diphenyl-1-1-cyclohexane), $M_w$=40,000] available from Mitsubishi Gas Chemical Company, Ltd. (123.5 parts) in a mixture of 546 parts of tetrahydrofuran (THF) and 234 parts of monochlorobenzene. The CTL was dried at 115° C. for 60 minutes. The solid component of treated alumina particles from Example I, which were predispersed in monochlorobenzene with a sonficator bath (Branson Ultrasonic Corporation, Model 2510R-MTH), was added to the solution in the above formulation to form a stable dispersion and roll milled for about 6 to about 36 hours.

The electrical properties of the above resulting photoconductive member were measured in accordance with the procedure described in Example IV.

| Device | $V_{ddp}$ (−V) | $E_{1/2}$ (Ergs/cm)$^2$ | Dark Decay (V @ 100 ms) | Vr (V) |
|---|---|---|---|---|
| Control device (CT without alumina) | 520 | 1.05 | 25 | 20 |
| Device with 5.5 weight percent alumina | 520 | 1.15 | 18 | 50 |

EXAMPLE XII

Composite Charge Transport Overcoat Layer with 5.5 Weight Percent Treated-Alumina (Belt Device)

An electrophotographic photoconductor device containing aluminum oxide particles was prepared by coating on a substrate of titanized MYLAR® precoated with silane block layer by a wire wound rod or a draw bar a charge generation layer followed by a coating of charge transport layer and top coating of a composite charge transport overcoat layer containing aluminum oxide filler.

| | |
|---|---|
| Hydroxygallium phthalocyanines | 22 parts |
| VMCH resin | 18 parts |
| n-butylacetate | 960 parts |

The charge generator layer was coated by a wire wound rod. The resulting film was dried and a thickness of about 0.2 μm was obtained.

| CTL Mixture | |
|---|---|
| Bisphenol Z-form polycarbonate | 130.7 parts |
| TBD | 87.1 parts |
| Toluene | 234 parts |
| Tetrahydrofuran | 546 parts |
| BHT | 2.2 parts |

The charge transport layer was coated by the known draw bar method to a thickness of about 25 μm.

Overcoating Mixture

Overcoat liquid formulated with 5.5 weight percent of surface treated alumina particles of Example I.

| | |
|---|---|
| Bisphenol Z-form polycarbonate | 50.5 parts |
| TBD | 33.7 parts |
| Monochlorobenzene | 910 parts |
| BHT | 0.85 parts |
| Alumina particles | 4.95 parts |

A thickness of about 5.4 μm for the composite charge transport overcoat layer was formed after drying.

The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 814 | 1.70 | 19 | 0.7 | 41.5 |
| OC Device with 5.5 weight percent $Al_2O_3$ | 817 | 1.62 | 23 | 1 | 9.6 |

EXAMPLE XIII

Composite Charge Transport Overcoat Layer with 10.5 Weight Percent Treated-Alumina (Belt Device)

The electrophotographic photoconductor device containing aluminum oxide filler was prepared in accordance with the processes of Example XII.

Charge generation coating dispersion (thickness of about 0.2 μm).

| | |
|---|---|
| Hydroxygallium phthalocyanines | 22 parts |
| VMCH resin | 18 parts |
| n-butylacetate | 960 parts |
| CTL Mixture: | |
| Bisphenol Z-form polycarbonate | 106.9 parts |
| TBD | 71.28 parts |
| Monochlorobenzene | 410 parts |
| Tetrahydrofuran | 410 parts |
| BHT | 1.8 parts |

The charge transport layer was coated on the generating layer above by a draw bar to a thickness of about 25 μm.

A photoconductive member was generated by repeating the above process, reference for example Example XII. The following nano-composite charge transport liquid formulated with 10.5 weight percent of alumina surface treated with phenyltrimethoxysilane from Example I was then coated (thickness of about 5.6 μm) on the above CTL (Charge Transport Layer).

| | |
|---|---|
| Bisphenol Z-form polycarbonate | 47.8 parts |
| TBD | 31.9 parts |
| Monochlorobenzene | 910 parts |
| BHT | 0.81 parts |
| Alumina particles | 9.5 parts |

The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 814 | 1.70 | 19 | 0.7 | 41.5 |
| OC Device with 10.5 weight percent $Al_2O_3$ | 815 | 1.66 | 21 | 3.4 | 5.8 |

EXAMPLE XIV

Composite Charge Transport Overcoat Layer with 20.5 Weight Percent Treated-Alumina (Belt Device)

The processes of Example XIII were repeated with the exception that the top overcoating liquid was replaced with the following formulation.

Nano-composite charge transport liquid formulated with 20.5 weight percent of alumina particles surface treated with the phenyltrimethoxysilane of Example I to a thickness of 4.4 microns.

| | |
|---|---|
| Bisphenol Z-form polycarbonate | 42.5 parts |
| TBD | 28.3 parts |
| Monochlorobenzene | 910 parts |
| BHT | 0.72 parts |
| Alumina particles | 18.5 parts |

The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 814 | 1.70 | 19 | 0.7 | 41.5 |
| OC Device with 20.5 weight percent $Al_2O_3$ | 815 | 1.71 | 20 | 3.8 | 2.8 |

EXAMPLE XV

Composite Charge Transport Overcoat Layer with 5.5 Weight Percent Treated-Alumina and 3 Weight Percent PTFE (Belt Device)

The processes of Example XIII were used except that the overcoat liquid was replaced with the following formulation.

Nano-composite charge transport liquid formulated with 5.5 weight percent of alumina particles surface treated with phenyltrimethoxysilane of Example I and 3 weight percent of PTFE.

| | |
|---|---|
| Bisphenol Z-form polycarbonate | 65.18 parts |
| TBD | 43.45 parts |
| Toluene | 436 parts |
| Tetrhydorfuran | 436 parts |
| BHT | 1.1 part |
| Alumina particles | 6.6 parts |
| PTFE | 3.6 parts |
| Dispersant (GF300) | 0.07 part |

A thickness for the above layer was about 6 μm.

The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without $Al_2O_3$ | 814 | 1.70 | 19 | 0.7 | 41.5 |
| OC Device with 5.5 wt. percent $Al_2O_3$ + 3 wt. percent PTFE | 813 | 1.64 | 17 | 3.58 | 9.4 |

EXAMPLE XVI

Composite Charge Transport Overcoat Layer with 5.75 Weight Percent Treated-Alumina (Drum Device)

An electrophotographic photoconductor device containing aluminum oxide filler was prepared by coating a charge photogeneration layer mixture indicated below followed by a charge transporting layer free of a metal oxide filler and then an overcoat layer containing aluminum oxide filler onto an aluminum drum substrate precoated with a titanium oxide under coating layer.

| | |
|---|---|
| Hydroxygallium phthalocyanines or mixture of alkylhydroxygallium phthalocyanines and hydroxygallium phthalocyanines | 22 parts |
| VMCH resin | 18 parts |
| n-butylacetate | 960 parts |

The charge generator layer was coated by a dip coating method to a thickness of about 0.2 μm.

The following charge transport coating liquid was formulated free of metal oxide.

| | |
|---|---|
| Bisphenol Z-form polycarbonate | 106.9 parts |
| TBD | 71.3 parts |
| Monochlorobenzene | 246 parts |
| Tetrahydrofuran | 574 parts |
| BHT | 1.8 parts |

The above charge transporting layer (CTL) was coated by dip coating method. The film was dried and a thickness of about 29.2 μm.

The following nano-composite overcoat liquid formulated with 5.75 weight percent of alumina particles surface treated with phenyltrimethoxysilane from Example I was then coated on the above CTL.

| | |
|---|---|
| Bisphenol Z-form polycarbonate | 50.3 parts |
| TBD | 33.59 parts |
| Monochlorobenzene | 910 parts |
| BHT | 0.85 parts |
| Alumina particles | 5.2 parts |

The above dispersion with solid components of alumina particles was prepared by predispersing alumina in a sonicator bath (Branson Ultrasonic Corporation Model 2510R-MTH) with monochlorobenzene and then added to the charge transporting liquid to form a stable dispersion and roll milled for a period of 36 hours before coating to a thickness about 5.1 μm.

The electrical and wear properties of the above resulting photoconductive member were measured in accordance with the procedure described in Example IV.

| Device | $V_{ddp}$ (−V) | $E_{1/2}$ (Ergs/cm)$^2$ | Dark Decay (V @ 100 ms) | Vr (V) |
|---|---|---|---|---|
| Control device (CT without alumina) | 520 | 1.05 | 25 | 20 |
| Device with 5.5 weight percent $Al_2O_3$ overcoat | 520 | 0.89 | 15 | 50 |

EXAMPLE XVII

Composite Charge Transport Overcoat Layer with 5.5 Weight Percent Treated-Alumina and 3 Weight Percent PTFE (Drum Device)

The processes of Example XVI were used except that the (CTL) overcoat liquid was replaced with the following formulation.

Nano-composite charge transport overcoat liquid formulated with 5.5 weight percent of alumina particles surface treated with phenyltrimethoxysilane of Example I and 3 weight percent of PTFE (thickness of about 6.3 μm).

| | |
|---|---|
| Bisphenol Z-form polycarbonate | 65.18 parts |
| TBD | 43.45 parts |
| Toluene | 436 parts |
| Tetrhydorfuran | 436 parts |
| BHT | 1.1 parts |
| Alumina particles | 6.6 parts |
| PTFE | 3.6 parts |
| Dispersant (GF300) | 0.07 parts |

| Device | $V_{ddp}$ (−V) | $E_{1/2}$ (Ergs/cm)$^2$ | Dark Decay (V @ 100 ms) | Vr (V) |
|---|---|---|---|---|
| Control device (CT without alumina) | 520 | 1.05 | 25 | 20 |
| Device with 5.5 weight percent alumina overcoat | 520 | 0.75 | 22 | 38 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive imaging member comprised of a substrate, a photogenerating layer, and in contact with said photogenerating layer a composite charge transport layer comprised of an aromatic resin and metal oxide particles, wherein said metal oxide particles are surface-attached with an arylsilane/arylsiloxane component having π—π interactions with said aromatic resin.

2. A photoconductive imaging member in accordance with claim 1 wherein said metal oxide is selected from the group consisting of aluminum oxide, silicon oxide, titanium oxide, cerium oxide, and zirconium oxide, and said attachment is accomplished at the surface of said metal oxide particles.

3. A photoconductive imaging member in accordance with claim 1 wherein said metal oxide particles have a diameter size of from about 1 to about 250 nanometers, and said attachment is accomplished at the surface of said metal oxide particles.

4. A photoconductive imaging member in accordance with claim 1 wherein said metal oxide particles are of a diameter size of from about 1 to about 199 nanometers.

5. A photoconductive imaging member in accordance with claim 1 wherein said metal oxide particles are present in said charge transport layer in an amount of from about 0.1 to about 50 percent by weight of total solids.

6. A photoconductive imaging member in accordance with claim 1 wherein said metal oxide particles are present in said charge transport layer in an amount of from about 1 to about 30 percent by weight of total solids.

7. A photoconductive imaging member in accordance with claim 1 wherein said metal oxide particles are produced by a plasma reaction process.

8. A photoconductive imaging member in accordance with claim 1 wherein said metal oxide particles are produced by a vapor phase synthesis process.

9. A photoconductive imaging member in accordance with claim 1 wherein said metal oxide particles are comprised of crystalline aluminum oxide.

10. A photoconductive imaging member in accordance with claim 9 wherein said crystalline aluminum oxide particles contain at least about 50 percent of γ-type crystalline particles.

11. A photoconductive imaging member in accordance with claim 9 wherein said crystalline comprised of from about 50 percent to about 90 percent of a γ-type crystalline structure, and from about 10 percent to about 50 percent of a δ-type crystalline structure.

12. A photoconductive imaging member in accordance with claim 9 wherein said aluminum oxide particles have a BET value of from about 20 to about 100 $m^2$/gram.

13. A photoconductive imaging member in accordance with claim 1 wherein said metal oxide particles are surface-attached with a silane of Formula (I)

$$R—Si(X)_nY_{3-n} \quad (I)$$

wherein R and X each independently represent an alkyl group of from about 1 to about 30 carbon atoms, an awl group optionally with from about 6 to about 60 carbon atoms, a substituted alkyl group or a substituted awl group optionally with from about 1 to about 30 carbon atoms; Y represents a reactive group that enables the attachment of the silane to the metal oxide particle surface, and n represents 0, 1, or 2.

14. A photoconductive imaging member in accordance with claim 13 wherein said alkyl group is selected from a group consisting of methyl, ethyl, hexyl, octyl, and cyclohexyl; and said aryl group is selected from a group consisting of phenyl, tolyl, biphenyl, benzyl, and phenylethyl.

15. A photoconductive imaging member in accordance with claim 13 wherein said substituted alkyl or said substantial aryl is selected from the group consisting of chloromethylene, trifluoropropyl, tridecafluoro-1,1,2,2-tetrahydroootyl, chlorophenyl, fluorophenyl, and perfluorophenyl.

16. A photoconductive imaging member in accordance with claim 13 wherein said Y is selected from the group consisting of a halogen, a hydroxyl, and an alkoxy.

17. A photoconductive imaging member in accordance with claim 16 wherein said alkoxy is selected from a group consisting of methoxy, ethoxy, propoxy, and isopropoxy.

18. A photoconduotive imaging member in accordance with claim 1 wherein said metal oxide is surface grafted with a cyclic siloxane of Formula (I)

(II)

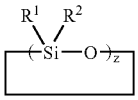

wherein $R^1$ and $R^2$ each independently represent an alkyl of from about 1 to about 30 carbon atoms, an aryl optionally with from about 6 to about 60 carbon atoms, a substituted alkyl or a substituted aryl optionally with from about 1 to about 30 carbon atoms, and z represents the number of segments, which number is optionally from about 3 to about 10.

19. A photoconductive imaging member in accordance with claim 18 wherein said cyclic siloxane is selected from the group consisting of hexamethylcyclotrisiloxane, 2,4,6-trimethyl-2,4,6-triphenylcyclotrisiloxane, 2,4,6,8-tetramethyl-2,4,6,8-tetraphenylcyclotetrasiloxane, hexaphenylcyclotrisiloxane, octamethylcyclotetrasiloxane, octaphenylcyclotetrasiloxane, and 2,4,6,8-tetramethyl-2,4,6,8-tetravinylcyclotetrasiloxane.

20. A photoconductive imaging member in accordance with claim 1 wherein said metal oxide particles contain, attached on the surface thereof, said silane or said siloxane present in an amount of from about 1 percent to about 30 percent by weight based on said metal oxide particles.

21. A photoconductive imaging member in accordance with claim 1 wherein said charge transport layer further contains charge transport molecules in an amount of from about 20 percent to about 50 percent by weight of total solids.

22. A photoconductive imaging member in accordance with claim 21 wherein said charge transport molecules are hole transport molecules selected from the group consisting of N,N'-diphenyl-N,N-bis(3-methyl phenyl)-1,1'-biphenyl-4,4'-diamine, N,N-bis(3,4-dimethyl phenyl)-N-biphenylamine, and N,N,N-triphenylamine.

23. A photoconductive imaging member in accordance with claim 1 wherein the imaging member further contains a second charge transport layer situated between said photogenerating layer and first charge transport layer, and wherein said second charge transport layer is comprised of a binder and hole transport molecules.

24. A photoconductive imaging member in accordance with claim 1 wherein said aromatic resin is selected from the group consisting of an aromatic polycarbonate, an aromatic polyester, an aromatic polyether, an aromatic polyimide, and an aromatic polysulfone.

25. A photoconductive imaging member in accordance with claim 1 wherein said aryl of said arylsilane/arylsiloxane is selected from the group consisting of a phenyl, a benzyl, a phenylethyl, and a naphthyl.

26. A photoconductive imaging member comprised of a conductive metal substrate selected from the group consisting of an aluminum drum, an aluminized polyethylene terephthalate or a titanized polyethylene terephthalate; a photogenerating layer comprised of a pigment selected from the group consisting of hydroxygallium phthalocyanine and chlorogallium phthalocyanine; an outmost or first composite charge transport layer comprised of a hole transport selected from the group consisting of N,N'-diphenyl-N,N-bis(3-methyl phenyl)-1,1'-biphenyl-4,4'-diamine and N,N-bis(3,4-dimethyl phenyl)-N-biphenylamine, a polycarbonate binder, and crystalline aluminum oxide particles attached with a silane.

27. A photoconductive imaging member in accordance with claim 26 wherein said aluminum oxide particles are comprised of at least about 50 percent of γ-type crystalline with a particle size of from about 1 to about 250 nanometers, and a BET value of from about 20 to about 100 $m^2$/gram, and said silane is an aryl silane.

28. A photoconductive imaging member in accordance with claim 26 wherein the imaging member further contains a charge transport layer situated between said photogenerating layer and said outmost composite charge transport layer, and wherein the charge transport layer is comprised of a polycarbonate binder and hole transport component selected from the group consisting of N,N'-diphenyl-N,N-bis(3-methyl phenyl)-1,1'-biphenyl-4,4'-diamine and N,N-bis(3,4-dimethyl phenyl)-N-biphenylamine.

* * * * *